US009375950B1

(12) United States Patent
Piatt et al.

(10) Patent No.: US 9,375,950 B1
(45) Date of Patent: Jun. 28, 2016

(54) IMAGE AUTHENTICATION USING SURFACE DEFORMATION CHARACTERISTICS

(71) Applicant: Eastman Kodak Company, Rochester, NY (US)

(72) Inventors: Michael J. Piatt, Dayton, OH (US); Terry Anthony Wozniak, Springfield, OH (US); James A. Katerberg, Kettering, OH (US)

(73) Assignee: EASTMAN KODAK COMPANY, Rochester, NY (US)

( * ) Notice: Subject to any disclaimer, the term of this patent is extended or adjusted under 35 U.S.C. 154(b) by 0 days.

(21) Appl. No.: 14/811,971

(22) Filed: Jul. 29, 2015

(51) Int. Cl.
*B41J 2/01* (2006.01)
*B41J 11/00* (2006.01)
*B41J 3/01* (2006.01)

(52) U.S. Cl.
CPC ..... *B41J 11/0015* (2013.01); *B41J 3/01* (2013.01)

(58) Field of Classification Search
CPC ..... B41J 2/01; B41J 2/2114; B41J 11/0015; B41M 5/52; B41M 7/00
USPC ..... 347/96, 100, 101, 107
See application file for complete search history.

(56) References Cited

U.S. PATENT DOCUMENTS

| | | | | |
|---|---|---|---|---|
| 5,764,263 | A * | 6/1998 | Lin | B41J 11/0015 347/101 |
| 6,139,139 | A | 10/2000 | Stoffel et al. | |
| 7,654,581 | B2 | 2/2010 | Cruikshank et al. | |
| 2008/0043085 | A1 | 2/2008 | Einhorn et al. | |
| 2011/0139024 | A1 | 6/2011 | Schiffmann | |
| 2012/0049506 | A1 | 3/2012 | Nikkila | |
| 2013/0161387 | A1 * | 6/2013 | King | B41F 33/00 235/431 |
| 2013/0271546 | A1 * | 10/2013 | Wilen | G06Q 20/28 347/107 |
| 2014/0131989 | A1 | 5/2014 | Pohjola et al. | |
| 2014/0161974 | A1 | 6/2014 | Erho et al. | |

* cited by examiner

*Primary Examiner* — Manish S Shah
*Assistant Examiner* — Roger W Pisha, II
(74) *Attorney, Agent, or Firm* — Kevin E. Spaulding

(57) ABSTRACT

A method for printing an image with authentication features, including: printing a media treatment material onto a print medium in accordance with a pattern of predefined authentication features, and printing one or more visible printing materials onto the print medium in accordance with an image pattern, thereby providing a printed visible image. The media treatment material, the one or more visible printing materials and the print medium interact to produce surface deformations of the print medium. Characteristics of the surface deformations are different in image regions where the media treatment material was printed than in image regions where the media treatment material was not printed, so that the difference between the characteristics of the surface deformations causes the pattern of authentication features to be detectable.

11 Claims, 7 Drawing Sheets

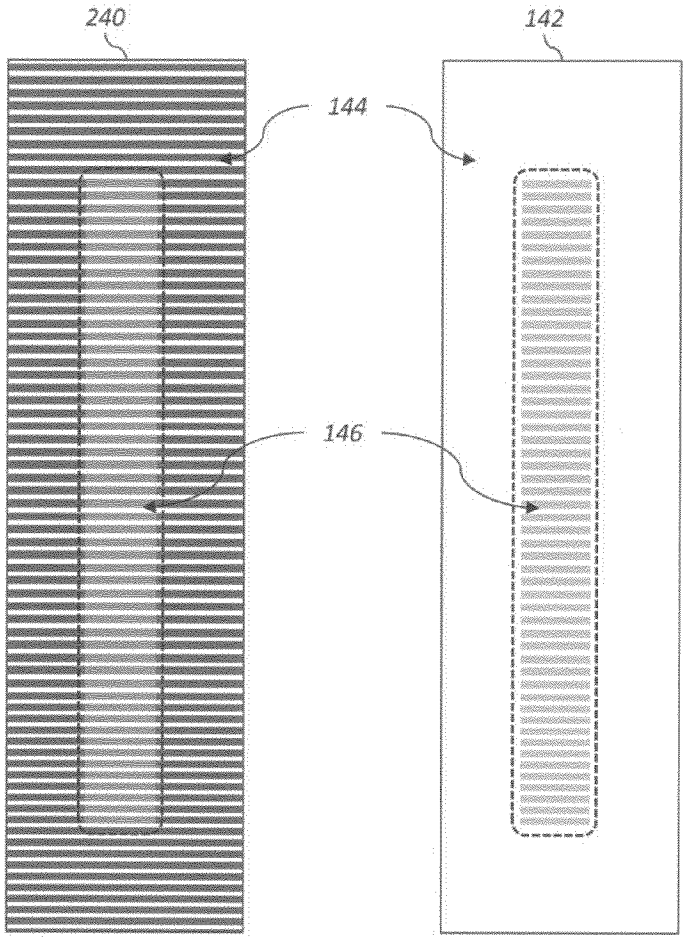
FIG. 6B
FIG. 6A
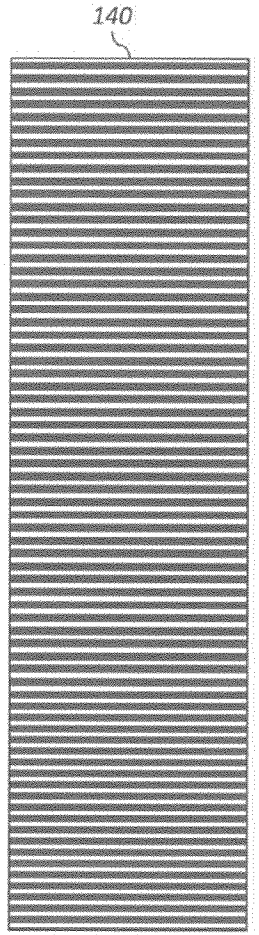
FIG. 5 (PRIOR ART)

IMAGE AUTHENTICATION USING SURFACE DEFORMATION CHARACTERISTICS

CROSS-REFERENCE TO RELATED APPLICATIONS

Reference is made to commonly assigned, co-pending U.S. patent application Ser. No. 14/811,947, entitled: "Image authentication using material penetration characteristics," by M. Platt et al.; and to commonly assigned, co-pending U.S. patent application Ser. No. 14/811,959, entitled: "Image authentication using lateral spreading characteristics," by M. Platt et al., each of which is incorporated herein by reference.

FIELD OF THE INVENTION

This invention generally relates to a digital printing systems, and more particularly to a method for printing images including image authentication features.

BACKGROUND OF THE INVENTION

Security has become more important in all aspects of society as threats through deception have become more prevalent. Printed documents are no exception. Printed media has been the long standing vehicle for communication of many official declarations such as stocks and bonds, legal documents such as wills, currency, licenses of various sorts, official records of transaction such as the sale or purchase of an item, documentation declaring value such as for jewelry, documentation declaration authenticity such as for art work, lottery tickets, and so forth. In recent times, counterfeit technologies have improved. High quality scanners to reproduce documentation are readily available at very low cost as are high quality output devices that can reproduce scanned images with a high level of accuracy. This can make it difficult to identify counterfeit material without significant forensic effort.

Many of the above mentioned applications have a limited print volume, often requiring only a single copy of a printed document. However, in addition to these applications, there are print production applications that may result in a lower monetary loss per counterfeit item but cumulatively can be most significant. Such applications occur frequently in packaging, ticketing, coupons, labeling, and so forth. A simple bar code in wide spread use today for such applications is not sufficient to verify authenticity because they are easily reproduced.

There remains a need for methods of producing authentic documentation that can easily be identified as such by providing overt identifying attributes that are very difficult or impossible to reproduce, and that can be produced using methods that are practical for high speed commercial digital printing devices, such as continuous inkjet printers.

SUMMARY OF THE INVENTION

The present invention represents a method for printing an image including authentication features using a printing system including a plurality of printing modules, comprising:

using a media treatment printing module to print a media treatment material onto a print medium in accordance with a pattern of predefined authentication features; and using one or more additional printing modules to print one or more visible printing materials onto the print medium in accordance with an image pattern specified by image data, thereby providing a visible image;

wherein the media treatment material, the one or more visible printing materials and the print medium interact to produce surface deformations of the print medium, and wherein characteristics of the surface deformations are different in image regions where the media treatment material was printed than in image regions where the media treatment material was not printed, so that the difference between the characteristics of the surface deformations cause the pattern of authentication features to be detectable.

This invention has the advantage that it produces printed images that include easily identifiable authentication features that can be produced using commercial digital printing devices, such as continuous inkjet printers.

It has the additional advantage that the media treatment material can be used to control surface deformation characteristics of the print medium, thereby causing the authentication features to be detectable.

It has the further advantage that the authentication features are difficult to reproduce on low-cost consumer printing systems.

BRIEF DESCRIPTION OF THE DRAWINGS

FIG. 5 shows an example of a visible image;

FIGS. 6A-6B show the front side and back side of an example printed visible image with authentication features formed by the media treatment material altering penetration characteristics of the visible printing materials;

DETAILED DESCRIPTION OF THE INVENTION

Figure 1:
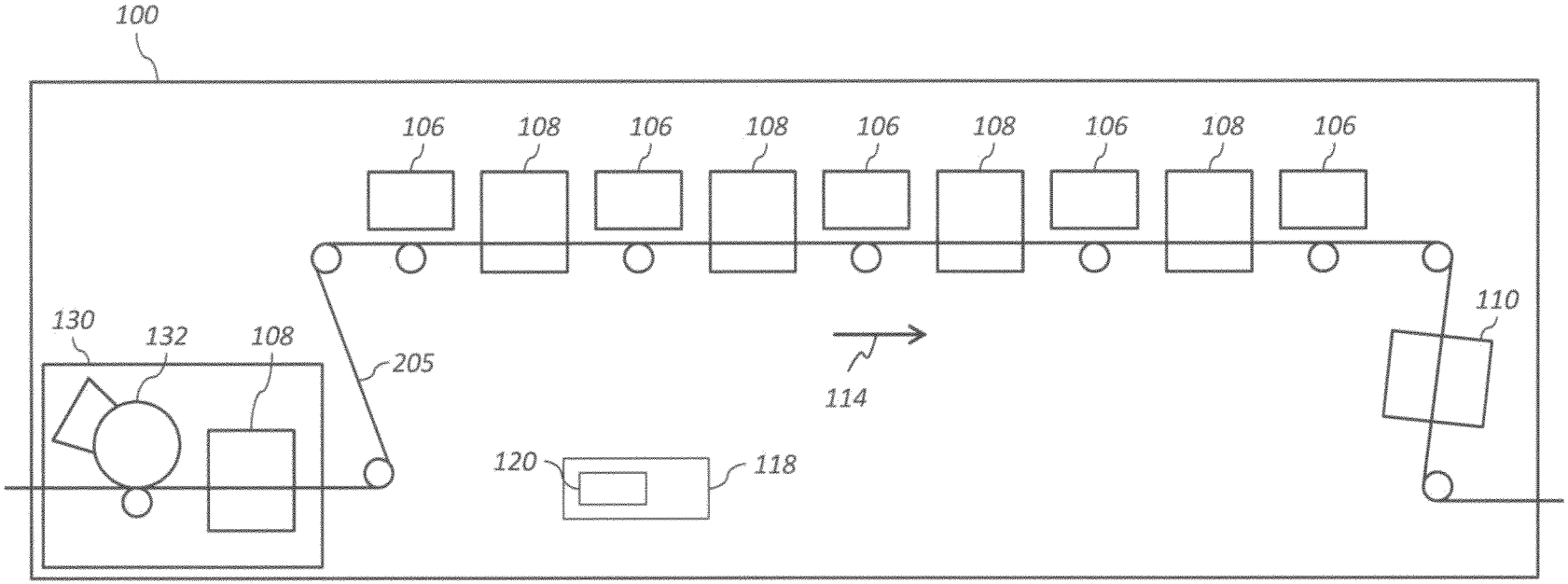
FIG. 1 is a schematic side view of a continuous web inkjet printing system.

The present description will be directed in particular to elements forming part of, or cooperating more directly with, apparatus in accordance with the present invention. It is to be understood that elements not specifically shown or described may take various forms well known to those skilled in the art.

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. The use of singular or plural in referring to the elements of the invention is not limiting. It should be noted that, unless otherwise explicitly noted or required by context, the word "or" is used in this disclosure in a non-exclusive sense. Where they are used, terms such as "first", "second", and so on, do not necessarily denote any ordinal or priority relation, but are simply used to more clearly distinguish one element from another.

The present invention is well-suited for use in roll-fed inkjet printing systems that apply colorant (e.g., ink) to a web of continuously moving print medium. In such systems, a printhead selectively moistens at least some portion of the media as it moves through the printing system. While the present invention will be described within the context of a roll-fed inkjet printing system, it will be obvious to one skilled in the art that it could also be used for other types of printing systems as well.

In the context of the present invention, the terms "web medium" or "continuous web of medium" are interchangeable and relate to a medium that is in the form of a continuous strip of medium as it passes through a web medium transport system from an entrance to an exit thereof. The continuous web medium serves as a print medium (sometimes referred to as a receiver medium) to which one or more colorants (e.g., inks or toners), or other coating liquids are applied. This is distinguished from various types of "continuous webs" or "belts" that are transport system components (as compared to the image receiving medium) which are typically used to transport a cut sheet medium in an electrophotographic or other printing system.

Inkjet printing is a non-contact application of an ink to a print medium. Typically, one of two types of inkjetting mechanisms is used, which can be categorized by technology as either drop-on-demand inkjet or continuous inkjet. The first technology, drop-on-demand inkjet printing, provides ink drops that impact upon a recording surface using a pressurization actuator, for example, a thermal, piezoelectric, or electrostatic actuator. One commonly practiced drop-on-demand technology uses thermal actuation to eject ink drops from a nozzle. A heater, located at or near the nozzle, heats the ink sufficiently to boil it, forming a vapor bubble that creates enough internal pressure to eject an ink drop. This form of inkjet is commonly termed thermal inkjet.

The second technology, commonly referred to as continuous inkjet printing, uses a pressurized ink source to produce a continuous liquid jet stream of ink by forcing ink, under pressure, through a nozzle. The stream of ink is perturbed using a drop forming mechanism such that the liquid jet breaks up into drops of ink in a predictable manner. One continuous printing technology uses thermal stimulation of the liquid jet with a heater to form drops that eventually become print drops and non-print drops. Printing occurs by selectively deflecting drops so that printing drops reach the print medium and non-printing drops are caught by a collection mechanism. Various approaches for selectively deflecting drops have been developed including electrostatic deflection, air deflection, and thermal deflection.

The present invention described herein is applicable to both types of inkjet printing technologies. As such, the terms printhead and jetting module, as used herein, are intended to be generic and not specific to either technology. Additionally, the present invention described herein is applicable to a wide variety of types of print medium. As such, the terms print medium, and web, as used herein, are intended to be generic and not as specific to one type of print medium or web, or the way in which the print medium or web is moved through the printing system.

FIG. 1 shows a schematic side view of a digital printing system 100 for continuous web printing according to one exemplary arrangement. The printing system 100 guides a web of print medium 205 along a media path in a transport direction 114 (generally left-to-right as shown in the figure), from a source roll (not shown) to a take up roll (not shown), through a media coating system 130 and past a plurality of printheads 106. The printheads 106 selectively apply ink (or some other fluid) to the print medium 205 according to appropriate image data. The terms "upstream" and "downstream" are terms of art referring to relative positions along the transport path of the print medium 205; the print medium 205 moves along the transport path from upstream to downstream. If both sides of the print medium 205 are to be printed, the print medium 205 can be inverted using a media inverter (not shown) and a second set of printheads 106 and dryers 108 be used to print on the second side of the print medium 205.

Each printhead 106 typically includes multiple jetting modules (not shown) that apply ink or another fluid (gas or liquid) to the surface of the print medium 205 that is adjacent to the jetting modules. The pattern of ink or other liquid applied by a printhead 106 to the surface of the print medium 205 is commonly referred to as an image plane or a color plane. Typically the printing system 100 will include printheads 106 for printing image planes for each of the primary colors; cyan, magenta, yellow, and black. The printing system 100, however, is not limited to such a configuration and can include fewer or more printheads 106 and can include other ink color options. In the illustrated configuration, dryers 108 are shown downstream of the first four printheads 106 for drying the liquids applied to the print medium 205, but the invention is not limited to this configuration.

One or more processors 118 can be connected to components in printing system 100 using any known wired or wireless communication connection. Processor 118 can be separate from printing system 100 or integrated within printing system 100 or within a component in printing system 100. Processor 118 can be a single processor or one or more processors. Each of the one or more processors can be separate from the printing system 100 or integrated within the printing system 100. The processor 118 can be used to control various components of the printing system 100. For example, processor 118 can be connected to the printheads 106 to control the printing of appropriate image data. Processor 118 can also be connected to various components in the web tension system and used to control the positions of those components, such as gimbaled or caster rollers. Processor 118 can also be connected to the image quality sensor 110 and used to process images or data received from the image quality sensor 110.

One or more storage devices 120 are generally connected to the processor 118. The storage device 120 can store data such as image data and color plane correction values. The storage device 120 can be implemented as one or more external storage devices, one or more storage devices included within the processor 118, or a combination thereof. The storage device can include its own processor and can have memory accessible by the one or more processors 118.

An image quality sensor 110 is located along the media path downstream of the printheads 106 for monitoring the quality of the images printed on the print medium 205. The output of the image quality sensor 110 can be provided to processor 118, which can adjust the operation of the printheads 106 in response to the sensed quality.

In various embodiments of the invention, a media treatment material is selectively applied to the print medium 205 in accordance with a pattern of predefined authentication features. The media treatment material can be applied using the media coating system 130, or using one of the printheads 106. Generally, at least some of the printheads 106 are configured to print visible printing materials, such as cyan magenta, yellow and black inks.

In an exemplary configuration, the media treatment material alters an interaction between the visible printing materials and the print medium 205 so that characteristics of the interaction between the one or more visible printing materials and the print medium 205 are different in image regions where the media treatment material was printed than in image regions where the media treatment material was not printed. The differences in the characteristics of the interaction between the one or more visible printing materials and the print medium 205 cause the authentication features to be detectable. In various embodiments, the characteristics of the interaction between the one or more visible printing materials and the print medium 205 can include some or all of printing material penetration characteristics, lateral spreading characteristics, or surface deformation characteristics.

In many applications, high levels of printing material penetration, lateral spreading or surface deformation are considered to be "image artifacts" and efforts are made to minimize these effects. However, inventors have recognized that these effects, which are characteristic of certain combinations of printing systems, inks and media, can be useful for authenticating that a printed article was produced on an authorized system. By applying a media treatment material in accordance with a pattern of authentication features, the magnitude of the "artifacts" can be controlled such that the authentication features have a different characteristic which causes them to be detectable.

It is known that certain metal cations and organic polycations can form insoluble salts or complexes with anionically charged colorants or dispersant polymers associated with dispersed pigment particles. The effect of this interaction is that the anionically charged colorants precipitate and become immobile, and the polymer dispersed particles aggregate strongly (coagulation) or weakly (flocculation) causing the pigmented colorants to also become immobile. It is common therefore to treat the print medium 205 with such metal salts or organic polycations so that they can quickly immobilize the dyes or pigments in the inks applied by the printheads 106 on the print medium 205. By quickly immobilizing these colorants, the spreading of these colorants across or into the print medium 205 can be reduced, yielding higher optical densities and sharper edge definition. The most common metal ions are calcium and magnesium, which are typically applied in the form of calcium or magnesium chloride salts. An appropriate organic polycation is poly(diallydimethylammonium chloride) ("poly(DADMAC)"). For certain dye-based inks, the print medium can be treated with polymeric dye mordants, such as poly(DADMAC) and poly(ethyleneimine) polymers and copolymers and mixtures thereof to quickly immobilize the colorants, thereby reducing the spread and penetration of the colorant within the print medium 205. Additional examples of polycation dye mordants include poly(dimethylaminoethyl)methacrylate, polyalkylenepolyamines, and products of the condensation thereof with dicyanodiamide, amine-epichlorohydrin polycondensates. Specific examples of such mordants include the following: vinylbenzyl trimethyl ammonium chloride/ethylene glycol dimethacrylate; poly(2-N,N,N-trimethylammonium)ethyl methacrylate methosulfate; poly(3-N,N,N-trimethyl-ammonium)propyl methacrylate chloride; a copolymer of vinylpyrrolidinone and vinyl(N-methylimidazolium chloride; and hydroxyethylcellulose derivatized with 3-N,N,N-trimethylammonium)propyl chloride.

In other specifically contemplated embodiments of the invention, the media treatment material is comprised of a weak or strong, inorganic or organic, protic acid which interacts with the anionically charged colorants or dispersed pigment particles causing them to change their mobility or become entirely immobile, for example through a change in solubility or by an aggregation process. Also specifically contemplated are media treatment materials containing organic solvents, ink vehicle co-solvents, humectants, penetrants, solvo-surfactants, surfactants and so forth, which alter the mobility of at least one colorant in the ink or the dimensions of the substrate or print medium, such as its thickness or planarity.

The media treatment material can be applied to the print medium 205 off-line before the print medium 205 is supplied to the printing system 100, or it can be applied by an on-line coating system such as media coating system 130 shown in FIG. 1. The coating can be applied using any appropriate type of media coater, such as a flexographic or gravure cylinder or a spray coater. Alternatively, the coating can be applied using an inkjet printhead 106. The media coating system 130 can include a dryer 108 to dry the coating on the print medium 205 prior to the print medium 205 reaching the print zone including the printheads 106.

In prior art systems, such media treatment materials have been applied uniformly to the print medium 205 in order to provide the image quality advantages associated with the dye and pigment immobilization over the entire printed image. However, inventors have recognized that image authentication features can be formed by selectively applying a media treatment material to the print medium in accordance in a pattern-wise manner. The media treatment material alters an interaction between the visible inks and the print medium 205 such that the authentication features will be detectable in the printed image.

In some cases, the authentication features are detectable by an observer directly viewing the printed image using the naked eye. In other cases, the authentication features can be detected by an observer viewing the printed image under magnification, or by using an image capture system to capture an image of the printed image, and then using an image analysis system to analyze the captured image to detect the presence of the authentication features.

The media treatment material alters the interaction between the visible printing materials (e.g., inks) and the print medium 205 such that one or more characteristics of the interaction are different in image regions where the media treatment material has been applied than in image regions where the media treatment material has not been applied. In an exemplary configuration, the media treatment material is a colorless material that alters the colorant penetration and lateral spreading characteristics such that the colorants (e.g., dyes and pigments) in the visible printing materials will exhibit less penetration into the print medium 205 and less lateral spreading within the print medium 205 in the image regions where the media treatment material has been applied.

In the image regions with less penetration and lateral spreading of the colorant, more colorant remains on the surface of the paper to produce higher print density and more intense colors. The reduction in lateral spreading in these image regions also reduces the diameter of printed dots and results in narrower printed lines when compared to the non-treated regions. The edges of printed strokes are also crisper, with less feathering or wicking of colorant along the fibers of the print medium 205, and sharper transitions between the printed regions and the non-printed regions. The pattern-wise application of the media treatment material therefore can produce detectable features in the printed image that are difficult to reproduce by other means.

Figure 2:
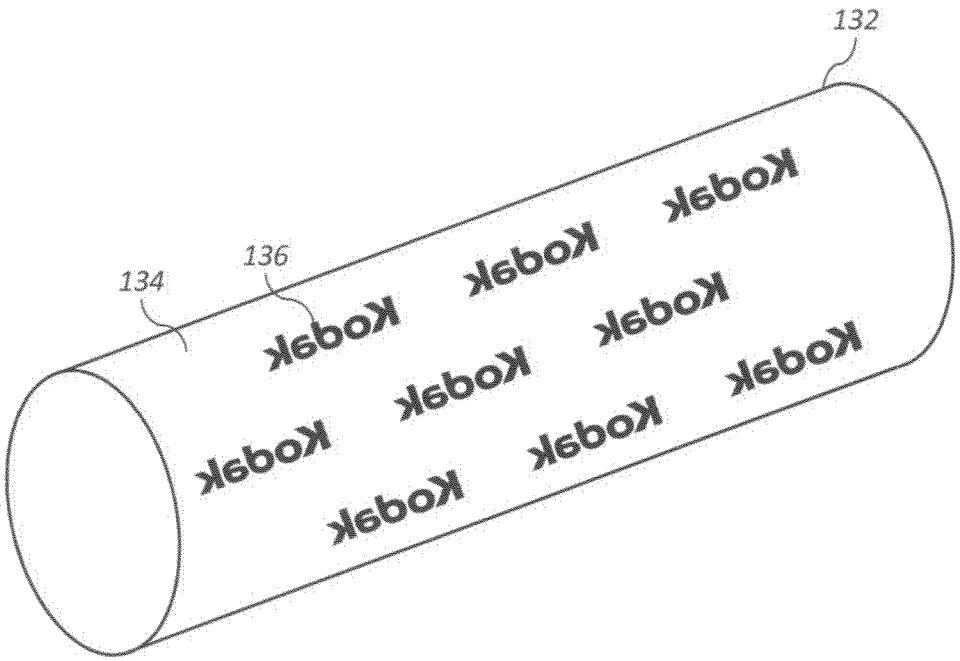
FIG. 2 shows a printing cylinder for applying a media treatment material to a print medium.

The media treatment material can be applied in a pattern-wise manner to the print medium 205 using any printing means known in the art to provide the pattern of predefined authentication features. In one configuration, the media treatment material can be applied using a patterned printing cylinder 132 in the media coating system 130. FIG. 2 shows an example of a printing cylinder 132 having a surface which is patterned in accordance with the authentication features. In this example, the media treatment material is applied to the print medium 205 in areas corresponding to treatment regions 134 and is not applied to the print medium 205 in areas corresponding to non-treatment regions 136. Means for providing the patterned printing cylinder 132 in accordance with the desired pattern of authentication features are well known in the art, and depend on the coating technology (e.g., flexographic, lithographic or gravure).

In the example shown in FIG. 1, the printing cylinder 132 applies the media treatment material onto the same side of the print medium 205 that the visible printing materials are printed using downstream printheads 106. In other configurations, the media treatment material can be applied to the opposite side of the print medium 205.

In preferred embodiments, the pattern of authentication features is selected to convey that validity of the printed image. In the example shown in FIG. 2, the treatment regions 134 and non-treatment regions 136 define a pattern of authentication features that convey textual content (i.e., the word "Kodak"). In other cases, the pattern of authentication features can convey graphical elements such as logos or other detectable patterns.

Figure 3:
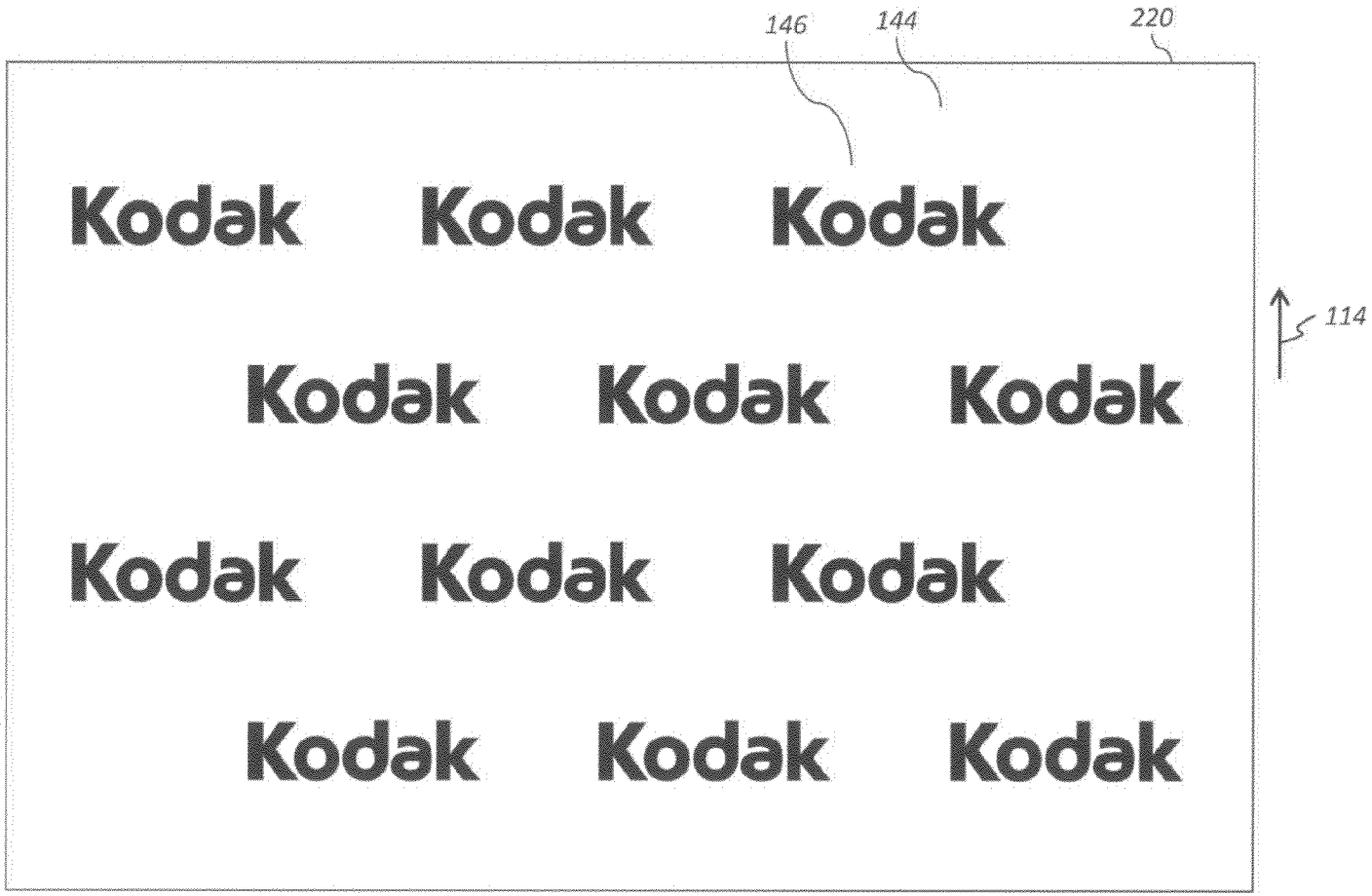
FIG. 3 shows a portion of a print medium having regions that have been treated using a media treatment material and regions that have been untreated.

FIG. 3 shows an example of a treated print medium 220 formed using the printing cylinder 132 of FIG. 2. The treated print medium 220 includes treated regions 144 corresponding to the treatment regions 134 of the printing cylinder 132, and non-treated regions 146 corresponding to the non-treatment regions 136 of the printing cylinder 132. (Note that while the treated regions 144 are shown as white and the non-treated regions 146 are shown as black in this figure for illustration purposes, the media treatment material will typically be colorless so that the pattern of authentication features will generally not be visible on the treated print medium 220.)

In the example of FIGS. 2-3, the non-treatment regions 136 (and corresponding non-treated regions 146) correspond to a set of textual characters (or other types of authentication features), and the treatment regions 134 (and corresponding treated regions 144) correspond to a background. In other configurations, the treatment regions 134 can correspond to the textual characters (or other types of authentication features), and the non-treatment regions 136 can correspond to the background.

In some embodiments, the media treatment material is selectively applied to the web or print medium 205 by means of one of the printheads 106, rather than by use of a separate media coating system 130. In such embodiments, the printhead 106 is controlled to selectively apply the media treatment material in accordance with the desired pattern of authentication features. In this case, the pattern of authentication features can be static, not changing from document to document, or alternatively the pattern of authentication features can be modified on a document-by-document basis. If the media coating system 130 uses a spray coater to apply the media treatment material, it could also be controlled to provide patterns of authentication features that can be modified on a document-by-document basis.

In some embodiments, the web of print medium 205 is uniformly treated by a first media treatment material, and a second media treatment material is selectively applied by means of one of the printheads 106. In some configurations, the first media treatment material inhibits the penetration or spreading of colorants of subsequently printed inks within the print medium 205, and the second media treatment material alters the effectiveness of the first media treatment material so that the colorants can more readily penetrate or spread laterally through the print medium 205.

In one exemplary configuration, the first treatment material that inhibits the penetration or spreading of colorants within the print medium 205 includes calcium or magnesium metal cations, which can be applied as highly water-soluble chloride salts. The second media treatment material can include sulfate, carbonate, or phosphate salts, which rapidly form insoluble salts with the calcium and magnesium cations. Metal cations made insoluble in this manner are not available to react with dyes or dispersed pigment particles, thereby allowing the colorants of subsequently printed inks to more readily penetrate or spread within the print medium 205. This can provide a variety of different effects that can be detected using appropriate means, including differences in the edge sharpness, line width, color-to-color bleed, hue, mottle, gloss, show-through and water-fastness.

In another exemplary configuration, the second media treatment material can include a sequestration agent, such as crown ether, which will complex the metal cations and render them less available to immobilize the colorants in the subsequently printed inks. Other examples of sequestration agents that are known to form complexes with metal cations are chelating agents such as ethylenediaminetetraacetic acid (EDTA), iminodisuccinic acid (IDS), polyaspartic acid (DS), methylglycinediacetic acid (MGDA), L-glutamic acid, N,N-diacetic acid, and tetrasodium salts of N,N-bis(carboxymethyl) glutamic acid (GLDA).

The first and second media treatment materials can be applied to the print medium 205 using any appropriate means. For example, the first media treatment material can be applied using an off-line coating system which pre-treats the print medium 205, and the second media treatment material can be applied using the media coating system 130. In another example, the first media treatment material can be applied to the print medium 205 using the media coating system 130, and the second media treatment material can be applied using one of the printheads 106. The treated print medium 220 with the first and second media treatment materials is typically dried before being printed on by subsequent printheads 106.

For cases where the media treatment material is applied using one of the printheads 106, any of the printheads 106 that have at least one downstream printhead 106 for subsequently printing an ink can be used. For example, in the five-printhead printing system 100 of FIG. 1, if the media treatment material is applied by the first printhead 106, then the media treatment material will affect the penetration and lateral spreading of all four subsequently printed inks. On the other hand, if the media treatment material is applied by the fourth printhead 106, then the media treatment material will affect the penetration and lateral spreading of only the ink printed using the last printhead 106. In this case, the penetration and spreading characteristics of the inks printed before the application of the media treatment material will be uniform across the print medium 205, while the penetration and spreading characteristics of the inks printed after the application of the media treatment material will show differences between the treated and untreated regions. Such differences between the penetration and spreading characteristics of the different inks can be useful to provide easily detectable authentication features.

The spreading and penetration of an ink within the print medium 205 requires some amount of time to occur. Rapid drying of the ink on the print medium 205 can immobilize the ink and thereby limit the penetration or lateral spread of the ink and the colorant it contains. Rapid drying of the ink can therefore reduce the differences in penetration and spread of the ink colorant between the treated and non-treated regions of the print medium 205. To slow the drying rate, and thereby enhance the differences in penetration and spreading of an ink colorant between the treated and non-treated regions of the print, the dryer 108 immediately downstream of the printhead 106 applying the ink can be turned off or operated at a reduced power level. In some embodiments, the dryer 108 can have different segments, each drying different swaths across the width of the print medium. Different power levels can be applied to the different segments to thereby vary the drying rate and enhance or alter the variation in penetration or spread of the ink colorant into the print medium across the width of the print medium 205 provided by the patterned application of the media treatment material on the print medium 205.

The variation in spreading or penetration of an ink colorant on a print medium 205 provided by the by the patterned application of the media treatment material on the print medium 205 can, in some embodiments, be made more visible by overprinting a second ink of a different color over a first ink. When the colorant of the first ink hasn't been immobilized by an agent in the media treatment material prior to the application of the second ink, significant color-to-color bleed can occur. This is particularly evident when the first ink hasn't been completely dried on the print medium 205 prior to the application of the second ink. Variations in the application of dryer power across the width of the print medium 205 can thereby enhance or alter the variation in color-to-color interactions across the width of the print medium 205 provided by the patterned application of the media treatment material on the print medium 205.

In some embodiments, a plurality of different colorants can be used whose mobility can be independently controlled using different media treatment materials. The different colorants can be applied as separate inks, or alternately they can be components of a single ink. For example, an ink can be used that includes both dye and pigment colorants. The dispersed pigment particles can be immobilized using a first media treatment material containing metal salts as has already been discussed. The dyes can be immobilized using a second media treatment material including polymeric dye mordants, such as poly(DADMAC) and poly(ethyleneimine). In some embodiments, one of the media treatment materials can be applied using the media coating system 130 and the other media treatment material can be applied using one of the printheads 106. In other embodiments, the first and second media treatment materials can be applied using two different printheads 106 or two different media coating systems 130. By selectively applying the first and second media treatment materials, the interaction of the colorants and the print medium 205 can be independently controlled to reduce mobility (e.g., reduce spread and penetration) of one or both of the pigment and dye colorants in different image areas. For example, the pigment can be immobilized on the surface of the print medium 205, while the dye can be free to penetrate into or spread across the print medium 205. Through this means, variations in characteristics such as lateral spread, color-to-color bleed, mottle or show-through can be provided across the print medium 205. If the different colorants in the ink have different hues, variations in the penetration or spread of the colorants across the print medium 205 can produce variations in the visible hue of the printed image or the show through image.

In embodiments of the invention in which the ink colorants are dyes, and the print media treatment includes a mordant to react with the dye, the mordant not only helps to more quickly immobilize the dye to reduce its penetration or lateral spreading in the print media, it also renders the dyes more waterfast. As a result, a pattern-wise application of the media treatment material including the mordant to the print medium 205 will produce a corresponding pattern-wise variation in the waterfastness of the image printed with the ink. A document printed in this manner can be authenticated by the application of water to the document to verify that the waterfastness of the printhead varies in the expected pattern-wise manner. Similarly, during or after the printing and drying steps, a high humidity treatment, such as steam, can be used to control the degree of lateral spread and penetration of water soluble dyes that have not been immobilized.

Figure 4:
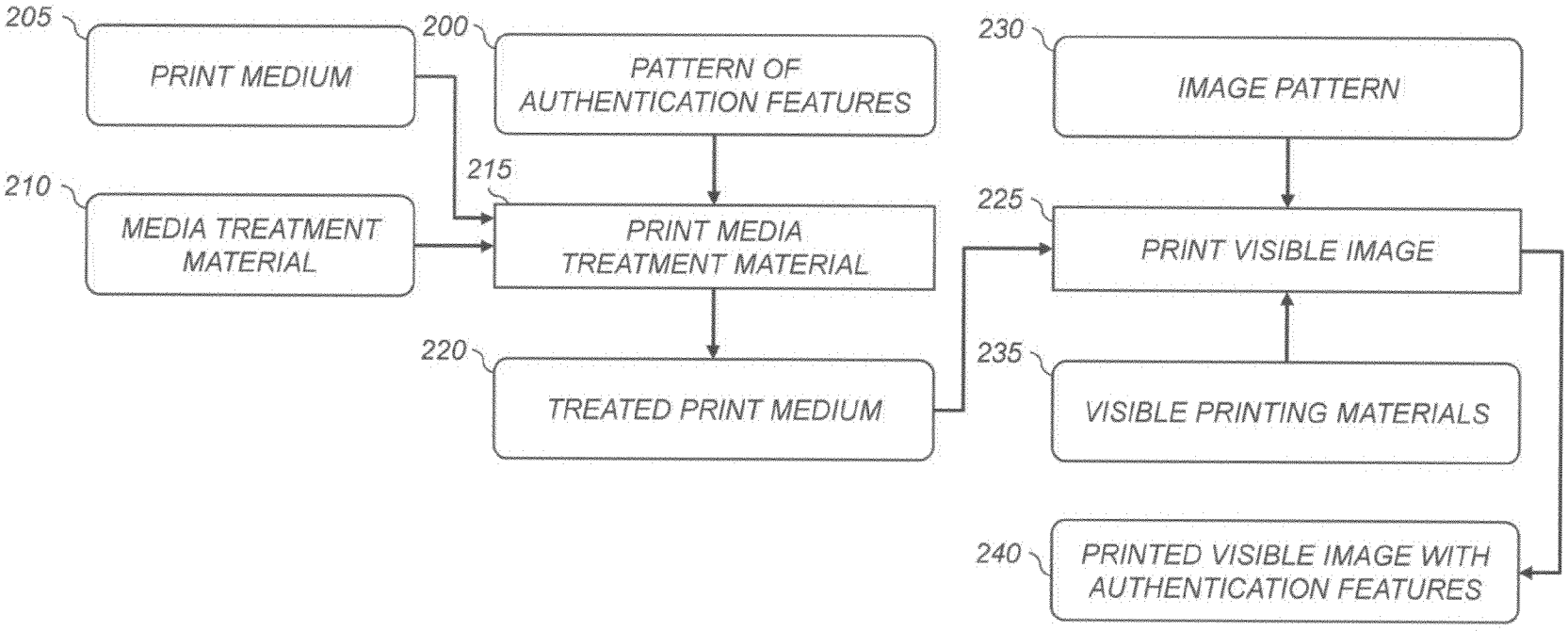
FIG. 4 shows a flowchart of a method for printing an image including authentication features in accordance with the invention.

FIG. 4 shows a flowchart of a method for forming printed images that include authentication features in accordance with the present invention. A print media treatment material step 215 is used to print a media treatment material 210 onto a print medium 205 in accordance with a pattern of predefined authentication features 200 to produce a treated print medium 220. As discussed earlier, the media treatment material 210 can be applied to the print medium 205 using various mechanisms such as a media coating system 130 or a printhead 106 in a digital printing system 100 (see FIG. 1). The mechanisms for applying the media treatment material 210 can be referred to as a media treatment printing module. The treated print medium 220 will include treated regions 144 and non-treated regions 146 as discussed earlier with respect to FIG. 3 in accordance with the pattern of predefined authentication features 200.

Next, a print visible image step 225 is used to print one or more visible printing materials 235 onto the treated print medium 220 in accordance with an image pattern 230 specified by image data, thereby providing a printed visible image 240 having authentication features. The visible printing materials 235 are printed using corresponding printing modules. In an exemplary configuration, the printing modules are inkjet printheads 106 of an inkjet printing system 100 as shown in FIG. 1, and the visible printing materials 235 are visible inks. For example, the visible inks can be cyan, magenta, yellow and black inks, although many other types of visible inks could also be used. In other embodiments, the printing modules can use other types of printing technologies besides inkjet printing. For example, the printing modules can be offset printing modules, flexographic printing modules, electrophotographic printing modules, or can use any other type of printing technology known in the art.

The media treatment material 210 has the property that it alters an interaction between at least one of the one or more visible printing materials 235 and the print medium 205 so that characteristics of the interaction are different in image regions where the media treatment material 210 was printed than in image regions where the media treatment material 210 was not printed, and wherein the differences in the characteristics of the interaction cause the pattern of authentication features 200 to be detectable. In some cases, the pattern of authentication features 200 in the printed visible image 240 can be detectable using the naked eye using conventional lighting. In other cases, the pattern of authentication features 200 may only be detectable using specialized viewing lights. In other cases, the pattern of authentication features 200 may only be detectable using an appropriate instrument such as a microscope or a digital imaging system designed to capture images of the printed visible image 240 with appropriate lighting. The captured images can be viewed on a display by a human observer, or can be analyzed using an image analysis system to detect the authentication features.

FIG. 5 shows an example of a magnified portion of a conventional visible image 140 printed with visible printing materials. The visible image 140 is printed in accordance with an image pattern that includes a series of horizontal lines.

FIG. 6A shows an example of a magnified portion of a simulated printed visible image 240 formed in accordance with an exemplary configuration of the present invention. The printed visible image 240 is formed using the method of FIG. 4 in which a media treatment material 210 is applied to the print medium 205 in accordance with a pattern of authentication features 200. In this example, the pattern of authentication features 200 provides a treated region 144 and an untreated region 146 that is in the shape of a capital letter "I."

In this example, the media treatment material 210 alters the interaction between the visible printing materials 235 and the print medium 205 such that the printing material penetration characteristics are different between the treated region 144 and an untreated region 146. In the treated region 144, the media treatment material 210 inhibits the penetration of the visible printing materials 235 into the print medium 205. Therefore, in the untreated region 146, the visible printing materials 235 penetrate more deeply into the print medium 205 leaving less of the visible printing materials 235 on the surface of the print medium 205. This causes the printed features of the printed visible image 240 to be lighter in the untreated region 146 than in the treated region 144, causing the authentication features to be detectable. This is due to reflection of light off the paper fibers that lie above or closer to the surface of the print medium 205 than the visible printing materials 235.

Depending on the characteristics of the print medium 205 and the visible printing materials 235, the authentication features in the example of FIG. 6A may also be detectable on the back side of the print medium 205. FIG. 6B shows an example where the material penetration characteristics are such that in the untreated region 146 the visible printing materials 235 penetrate into the print medium 205 to a depth that they become detectable on the back side of the print medium 205 as illustrated by the bleed-through image 142 of FIG. 6B. (This effect is sometimes referred to as bleed-through or show-through.) This effect can be more pronounced on thinner types of print medium 205. In some cases, the characteristics of the print medium 205 and the visible printing materials 235 can be selected such that authentication patterns are visible when viewing the back surface of the print medium but are substantially not visible when viewing the front surface of the print medium. Within the context of the present invention, "substantially not visible" is defined to mean that the reflection optical density does not change by more than 0.05.

In the example of FIGS. 6A-6B, the media treatment material 210 inhibits the penetration of the visible printing materials 235 into the print medium 205. For example, the visible printing material 235 can be an ink including a solution of a dye or a dispersed pigment, and the media treatment material 210 can include a dissolved salt that interacts with the ink to decrease the mobility of the dye or the dispersed pigment within the print medium 205, thereby inhibiting the penetration of the visible printing materials 235 into the print medium 205. For example, the dissolved salt can include metal cations (e.g., calcium or magnesium cations) or organic polycations (e.g., diallydimethylammonium chloride) that react with components of the ink to form insoluble salts that have a decreased mobility within the print medium 205.

In other examples, the media treatment material 210 can include a hydrophobic component that inhibits the penetration of the visible printing materials 235 into the print medium 205. Examples of such hydrophobic components include oils and waxes.

In an alternate configuration, the media treatment material 210 enhances penetration of the visible printing materials 235. This would cause the density of the visible printing materials 235 to be higher in the untreated regions of the print medium 205 than in the regions that are treated with the media treatment material 210. It can also cause the visibility of the visible printing materials 235 on the back surface of the print medium 205 to be higher in image regions where the media treatment material 210 was printed than in the untreated regions. For example, as discussed earlier, the print medium 205 can be uniformly pre-treated with a first media treatment material that inhibits penetration of the visible printing materials 235, and a second media treatment material can be applied using the print media treatment material step 215 that alters the effectiveness of the first media treatment material so that the visible printing materials 235 can more readily penetrate or spread laterally through the print medium 205.

In some embodiments, the print medium 205 has a fluid capacity such that adding fluid in excess of the fluid capacity alters the penetration and spreading characteristics. In this case, the media treatment material 210 can be water or some other fluid that is added in an amount such that the combination of the media treatment material 210 and the visible printing materials 235 exceeds the fluid capacity.

Figure 7B:
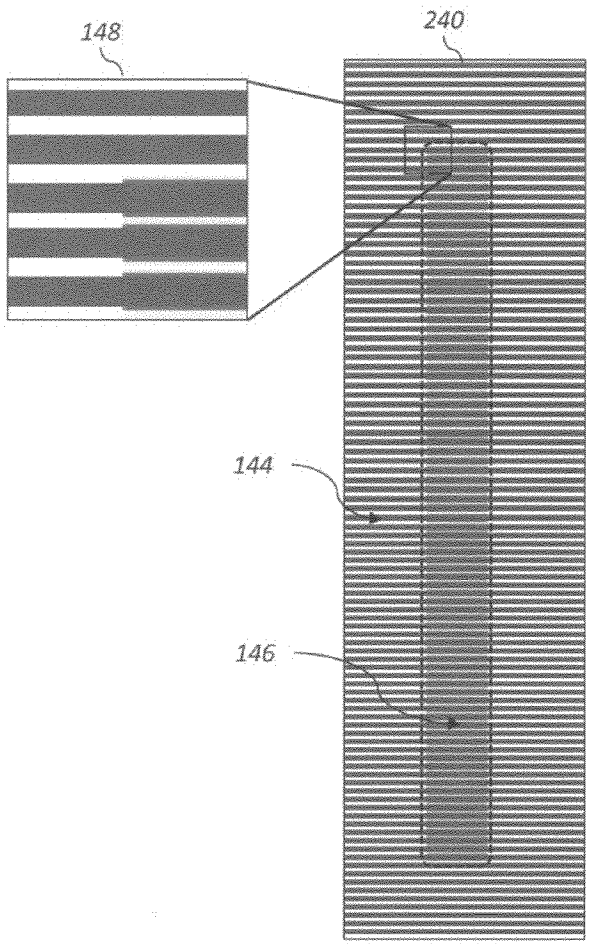
FIGS. 7A-7B show examples of printed visible images with authentication features formed by the media treatment material altering lateral spreading characteristics of the visible printing materials.
Figure 7A:
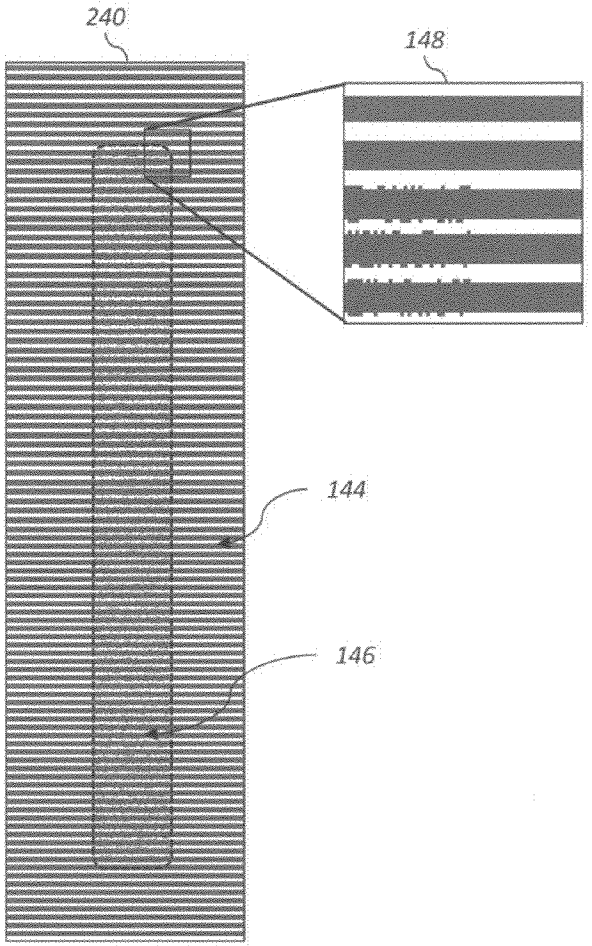

FIGS. 7A-7B show additional examples of magnified portions of simulated printed visible images 240 formed in accordance with an exemplary configuration of the present invention. In these examples, the media treatment material 210 alters the interaction between the visible printing materials 235 and the print medium 205 such that lateral spreading characteristics of the visible printing materials 235 are different between the treated region 144 and an untreated region 146. In the illustrated examples, the media treatment material 210 inhibits the migration of the visible printing materials 235 within the print medium 205, thereby reducing a magnitude of lateral spreading of the visible printing materials 235 in the treated region 144 where the media treatment material 210 was printed. The lateral spreading of the visible printing materials 235 will therefore be larger in the untreated region 146.

The difference in the lateral spreading characteristics can manifest itself in a number of different ways that cause the pattern of authentication features 200 to be detectable. In the example of FIG. 7A, the larger magnitude of the lateral spreading in the untreated region 146 causes the pattern of lines in the exemplary image pattern 230 printed using the visible printing materials 235 to have less distinct edges. For example, this can occur as the colorant spreads along the fibers of the print medium 205 by a "wicking" effect. In the example of FIG. 7B, the larger magnitude of the lateral spreading in the untreated region 146 causes the pattern of lines in the exemplary image pattern 230 to become wider. The inset images 148 in FIGS. 7A-7B show these effects in additional detail. In many cases, the larger magnitude of the lateral spreading in the untreated region 146 will cause the pattern of lines to simultaneously become wider and have less distinct edges.

The changes in the printed visible image 240 that result from the larger magnitude of the lateral spreading can be detected in a variety of ways. For example, a digital image can be captured and analyzed to detect the presence of wider or less distinct lines. This can be done by analyzing the edge transitions in the captured digital image to evaluate an amount of edge sharpness or a spatial position of the edge transition.

The edge sharpness can be used as an indication of the degree of distinctness of the lines. The spatial positions of the edge transitions can be used to characterize the width of the lines.

In some configurations, the changes in the lateral spreading characteristics can change the appearance of the printed visible image 240 in a way that can be detected visually. For example, the wider lines of FIG. 7B will typically cause the average reflection optical density in the untreated region 146 to be higher than in the treated region 144.

The horizontal lines in the exemplary image pattern 230 used to form the printed visible image 240 of FIGS. 7A-7B using the visible printing materials 235 represents an example of a texture pattern, where the appearance of the texture pattern changes in accordance with the difference of the lateral spreading characteristics. Those skilled in the art will recognize that a wide variety of texture patterns could be used whose visible appearance would change as the lateral spreading characteristics change. For example, halftone image patterns including regular or irregular patterns of dots would exhibit a similar effect.

In some embodiments, the image pattern 230 can be selected to include texture patterns that are particularly sensitive to changes in the lateral spreading characteristics. For example, texture patterns having printed image features separated by narrow gaps can be particularly susceptible to having their appearance changed as lateral spreading of the colorants will fill in the narrow gaps. Such gaps can sometimes occur naturally in the visible image content. For example fine text will contain small gaps between the strokes of the printed characters (e.g., the hole in the lowercase letter "e").

In the example of FIGS. 7A-7B, the media treatment material 210 inhibits the lateral spreading of the visible printing materials 235 within the print medium 205. As was discussed earlier, in some embodiments the media treatment material 210 applied by the print media treatment material step 215 can enhance the lateral spreading rather than inhibiting it. This would cause the pattern of lines to become wider and have less distinct edges in the regions of the print medium 205 that are treated with the media treatment material 210 compared to the untreated regions. For example, as discussed earlier, the print medium 205 can be uniformly pre-treated with a first media treatment material that inhibits lateral spreading of the visible printing materials 235, and a second media treatment material can be applied using the print media treatment material step 215 that alters the effectiveness of the first media treatment material so that the visible printing materials 235 can more readily spread laterally through the print medium 205.

Surface deformations are another type of detectable interaction between the print medium 205 and the applied visible printing materials 235. Such surface deformations are sometimes referred to as "cockle artifacts" and can include rippling, wrinkling, puckering or curling of the print medium 205. In some configurations of the invention, the media treatment material 210 is used to control the characteristics of the surface deformations in accordance with a pattern of predefined authentication features.

Figure 8:
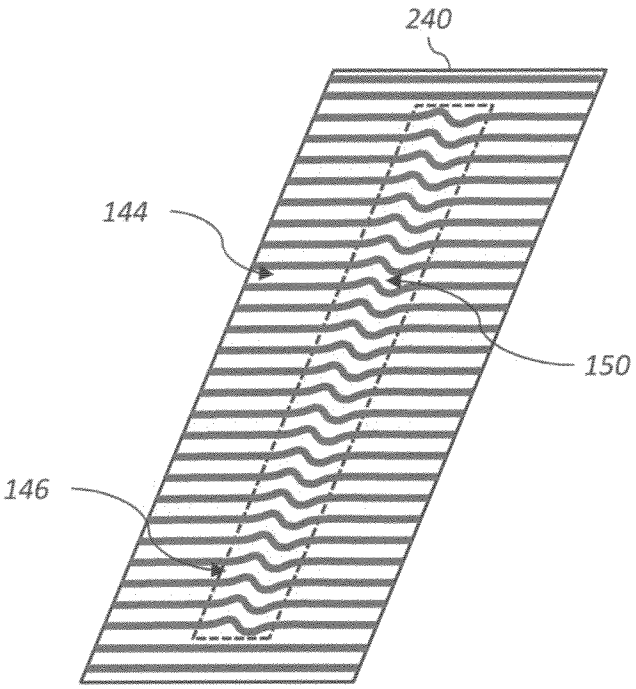
FIG. 8 shows a perspective view of an example printed visible image with authentication features formed by the media treatment material altering media deformation characteristics.

FIG. 8 shows a perspective view of an additional example of a magnified portion of simulated printed visible image 240 formed in accordance with an exemplary configuration of the present invention. In this example, the media treatment material 210 alters the interaction between the visible printing materials 235 and the print medium 205 such that surface deformation characteristics are different between the treated region 144 and an untreated region 146. In the illustrated example, the media treatment material 210 inhibits the formation of surface deformations in the printed visible image 240, thereby reducing a magnitude of "cockle" in the treated region 144 where the media treatment material 210 was printed. Surface deformations 150 of the printed visible image 240 will therefore be larger in the untreated region 146. In this example, the untreated region 146 is shown to be "cockled" with a substantial surface deformation extending along the length of the untreated region 146, while the treated region 144 has no significant cockles. The difference between the characteristics of the surface deformations cause the pattern of authentication features 200 to be detectable.

Some examples of media treatment materials 210 that are known to inhibit the formation of surface deformations in inkjet printing systems are urea, alkyl ketone dimer or 1,5-pentanediol.

In the example of FIG. 8, the media treatment material 210 inhibits the formation of surface deformations 150 in the treated region 144. In other embodiments the media treatment material 210 applied by the print media treatment material step 215 can enhance the formation of surface deformations rather than inhibiting it. Some example of media treatment materials 210 that are known to increase the formation of surface deformations are polyvinyl alcohol and p-toluenesulfonic acid. Many types of print medium 205 are particularly susceptible to the formation of surface deformations if the amount of fluid that is applied to the print medium 205 exceeds a certain fluid capacity threshold. Therefore, if the amount of the visible printing materials that are applied by the print visible image step 225 is constrained to be below this fluid capacity threshold, the magnitude of the surface deformations in the untreated region 146 will be minimal. In this case, the print media treatment material step 215 can be used to apply an amount of media treatment material 210 such that the total amount of fluid applied to the print medium in the treated region 144 will exceed the fluid capacity threshold, thereby increasing the magnitude of the surface deformations in the treated region 144. In such configurations, the media treatment material 210 can simply be water, or some other colorless fluid that is compatible with the visible printing materials 235.

The uses of this invention may include unique and verifiable identification of the location of manufacturing or processing. For example, regulated products such as pharmaceuticals may be packaged in printed materials that add an extra layer of security over a simple bar code and date verifying their origin. This verification can be readily identified by the merchant and end user of such products. These may be single prescriptions, perhaps ordered on-line and sent through the mail, or high volume over-the-counter medications such as cold remedies or vitamins. The technology can also be used for any packaged substance that could be consumed or considered hazardous. The technology may be used to verify jurisdiction for tax purposes, such as markings on cigarette packs that are designated for a given region. Or, the technology may be used to prevent counterfeit of wine and other spirits produced at a designated location.

A verification of authenticity provided by this technology is of particular value for parts used by the military, as well as civilian applications involving safety. Security printing that is easily identifiable and is difficult to reproduce can have broad reaching applications and offer significant value.

The invention has been described in detail with particular reference to certain preferred embodiments thereof, but it will be understood that variations and modifications can be effected within the spirit and scope of the invention.

PARTS LIST

100 printing system
106 printhead

108 dryer
110 image quality sensor
114 transport direction
118 processor
120 storage device
130 media coating system
132 printing cylinder
134 treatment region
136 non-treatment region
140 visible image
142 bleed-through image
144 treated region
146 non-treated region
148 inset image
150 surface deformations
200 pattern of authentication features
205 print medium
210 media treatment material
215 print media treatment material step
220 treated print medium
225 print visible image step
230 image pattern
235 visible printing materials
240 printed visible image

The invention claimed is:

1. A method for printing an image including authentication features using a printing system including a plurality of printing modules, comprising:

using a media treatment printing module to print a media treatment material onto a print medium in accordance with a pattern of predefined authentication features; and using one or more additional printing modules to print one or more visible printing materials onto the print medium in accordance with an image pattern specified by image data, thereby providing a visible image;

wherein the one or more visible printing materials and the print medium interact to produce surface deformations of the print medium, and wherein the media treatment material alters the interaction between the one or more visible printing materials and the print medium such that characteristics of the surface deformations are different in image regions where the media treatment material was printed than in image regions where the media treatment material was not printed, so that the difference between the characteristics of the surface deformations cause the pattern of authentication features to be detectable.

2. The method of claim 1, wherein the media treatment material increases a magnitude of the surface deformations of the print medium in image regions where the media treatment material was printed.

3. The method of claim 1, wherein the media treatment material inhibits the formation of surface deformations in the print medium, thereby decreasing a magnitude of the surface deformations in the print medium in image regions where the media treatment material was printed.

4. The method of claim 3, wherein the media treatment material includes urea, alkyl ketone dimer or 1,5-pentanediol.

5. The method of claim 1, wherein the print medium includes a front surface and an opposing back surface, the one or more visible printing materials being printed onto the front surface of the print medium, and wherein the media treatment material is printed onto the back surface of the print medium.

6. The method of claim 1, wherein at least one of the visible printing materials is printed onto the print medium before the media treatment material is printed onto the print medium.

7. The method of claim 1, wherein at least one of the visible printing materials is printed onto the print medium after the media treatment material is printed onto the print medium.

8. The method of claim 1, wherein the media treatment material is colorless.

9. The method of claim 1, wherein the media treatment printing module uses a printing cylinder to print the media treatment material onto the print medium.

10. The method of claim 1, wherein the media treatment printing module uses an inkjet printhead to print the media treatment material onto the print medium.

11. The method of claim 1, wherein at least one of the one or more additional printing modules is an inkjet printing module which uses an inkjet printhead to apply visible printing material onto the print medium.

* * * * *